United States Patent [19]

DeMartino

[11] Patent Number: 4,625,357

[45] Date of Patent: Dec. 2, 1986

[54] TOOTHBRUSH

[76] Inventor: John D. DeMartino, 348 Green Hill Rd., Longmeadow, Mass. 01104

[21] Appl. No.: 771,353

[22] Filed: Aug. 30, 1985

[51] Int. Cl.[4] ..... A46B 9/04

[52] U.S. Cl. ..... 15/167 A

[58] Field of Search ..... 15/167 R, 167 A, 110, 15/114; 128/62 A

[56] References Cited

U.S. PATENT DOCUMENTS

| | | | |
|---|---|---|---|
| 887,181 | 5/1908 | Barnes | 15/167 A |
| 1,133,930 | 3/1915 | Carroll | 15/167 A |
| 2,090,663 | 8/1937 | Booth | 15/167 A |

FOREIGN PATENT DOCUMENTS

| | | | |
|---|---|---|---|
| 550724 | 12/1922 | France | 15/167 A |

*Primary Examiner*—Peter Feldman

*Attorney, Agent, or Firm*—Ross, Ross & Flavin

[57] ABSTRACT

The handle of the toothbrush has a bifurcated forward end. The spaced free outer ends of the bifurcations are interconnected by a transversely extending arched head defining opposite lower side walls and an upper middle wall therebetween. Tufts of bristles project inwardly from the inner wall of the head. The tufts project from the opposite side walls at an angle to the horizontal center line of the head and the tufts projecting from the middle wall point toward the center point of the head.

1 Claim, 8 Drawing Figures

TOOTHBRUSH

My invention relates to new and useful improvements and structural refinements in a toothbrush having general utility in the arts, and more particularly aims to provide improvements in the art of brushing teeth. It is especially directed to a novel configuration of brush head for the cleaning of all tooth surfaces more comfortably and more efficiently while at the same time accomplishing a massaging of the gingival margins.

Caries is the pathological process of localized destruction of tooth tissue by microorganisms. Caries of the enamel is believed to be preceded by the formation of microbial dental plaque. The control of dental caries and periodontal disease pesents one of the greatest challenges encountered by the dental profession.

It is not sufficient that the profession perfect techniques to repair the damage to the dental apparatus that has already occured. It is a general failure of the healing profession that treatment of the diseased state is overemphasized and prevention is minimized.

Of the three general methods of controlling dental disease: 1. chemical 2. dietary and 3. mechanical, I have chosen the mechanical method as the one most universally and readily available for use as a dental disease deterrent. That a clean tooth does not decay is not totally based on true scientific evidence; it is more reasonable to state that a tooth surface, free of microorganisms and carbohydrates, would not become carious.

The invention hereof is intended to aid in the simultaneous removal of plaque from the lingual, occlusal, and buccal surfaces of teeth, and without the need for any great or unique manual dexterity.

The configuration and dimensions are such as to permit its use for anyone from adolescent to adult, and it is especially effective for those wearing braces.

One of the factors involved in the explanation of the failure of tooth brushing to prevent dental disease is the difficulty of reaching susceptible exposed areas of the teeth upon which dental plaques form.

The arch-shaped head of the brush of this invention is disposed in a plane transverse to the handle plane and somewhat below the generally elongated longitudinally-extending handle plane by virtue of a bifurcation of the handle at its forward end, which bifurcation allows a generally downward curve in the configuration of each of the resultant two arms, the head interconnecting the termini of the two arms in a transversely extending arrangement while at the same time defining a generally arched configuration.

This head arrangement with reference to handle permits a user to reach the buccal and lingual surfaces of each of his teeth without experiencing any discomfort and, having reached these surfaces, to brush same more efficiently and further, to reach into those confined areas where the gingival crest meets the interproximal areas of adjacent teeth, all so as to aid in realizing the desideratum of obtaining an improved cleaning action in the form of bacterial plaque reduction.

A particularly significant feature of novelty herein lies in the strategic positioning of the bristle tufts in rows, on the arched inside wall of the head, the tufts extending inwardly from the opposite side walls of the head and toward each other and extending downwardly from the intermediate wall portion between the opposite side walls, to the end that a sufficiency of bristles is to be found in the lower region of the head in order to allow an improved cleansing action on the so-called cervical areas, i.e., those areas nearest the gums, and an improved massaging action on the gingival margins.

The invention is capable of receiving a variety of mechanical expressions, one of which is shown on the accompanying drawings, but it is to be expressly understood that the drawings are for the purpose of illustration only and are not to be construed as a definition of the limits of the invention.

Figure 9:
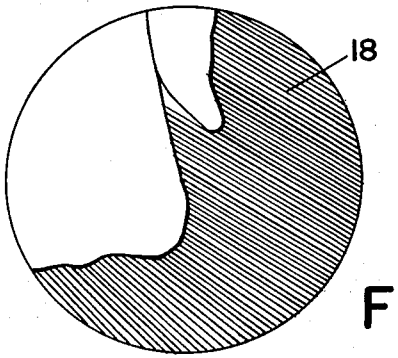
Figure 8:
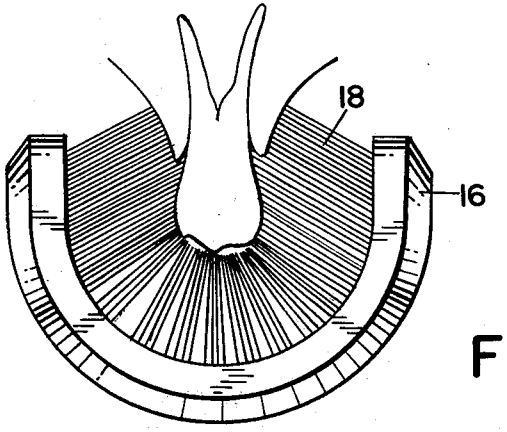

FIG. 8 is a view in end elevation showing the relationship of a plurality of bristles to a tooth and to its associated gingival margin and gingival sulcus; and FIG. 9 is a broken view showing the relationship of the crown of a tooth (that part of the tooth which is separated from the root structure by the cemento-enamel juncture) to the bristles as they are brought into contact with both the buccal and lingual surfaces and its occlusal surface as well and also extend into the free gingival sulcus on both buccal and lingual surfaces.

An elongated handle 10 is provided with the usual finger engaging enlargement 12 strategically spaced along its length and forwardly thereof a bifurcation to define a pair of arms 14, 14 which diverge from each other as they each bend downwardly in slow curves at an obtuse angle to the general handle plane.

It will be recognized that, for reasons of esthetics and ease in manipulation, there is desirably provided a slight curvature in the handle, which curvature allows for a maximum bracing between the thumb phalange and the abductor digiti minimi and flexor digiti minimi brevis of the palm so as to provide a double bracing of the handle within the hand thereby allowing the brush head to function as intended without the need for any great or particularly unique manual dexterity.

Figure 1:
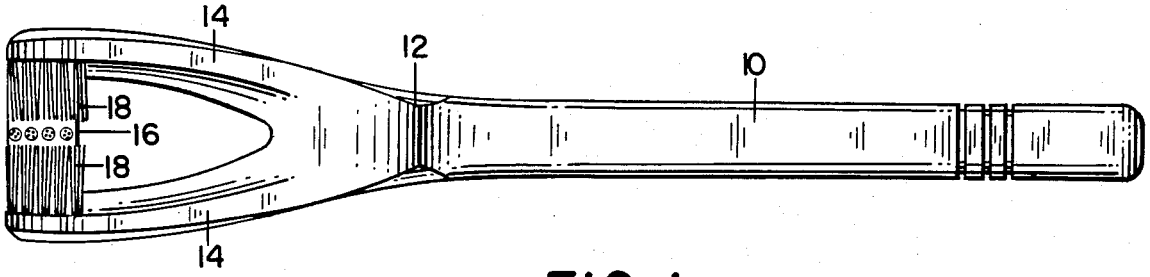
FIG. 1 is an inverted view in top plan of the brush of the invention.
Figure 2:
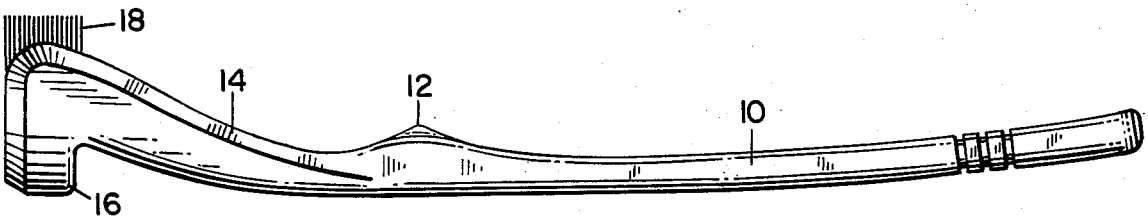
FIG. 2 is a view in side elevation of the FIG. 1 brush; showing the handle curvature which allows for greater security within the hand palm and ready receipt within the average tooth brush holder.
Figure 3:
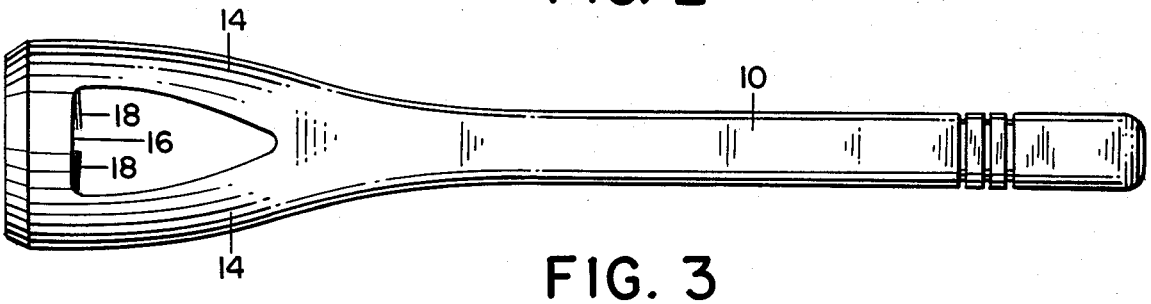
FIG. 3 is a view top plan of the FIG. 1 brush.
Figure 4:
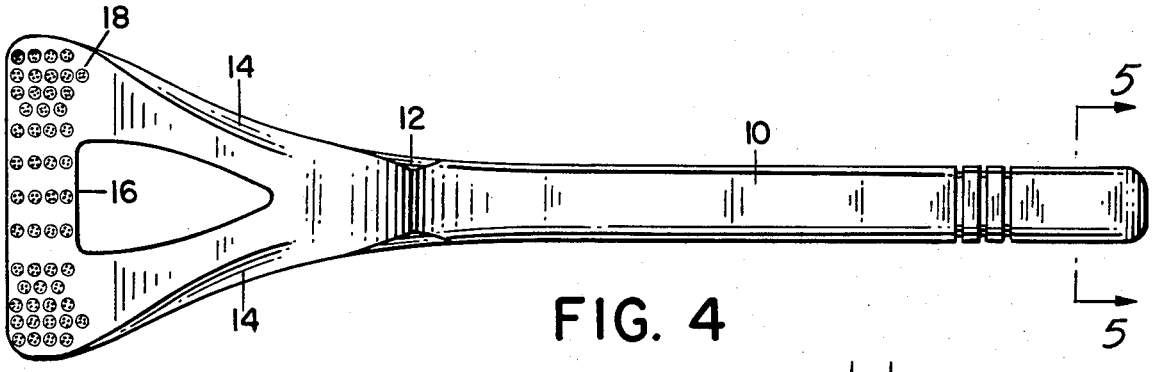
FIG. 4 is a view in inverted plan with the arched head being shown in an opened flattened position so as to more clearly show the staggered arrangement of the rows of tufts.
Figure 5:
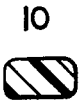
FIG. 5 is a sectional view on line 5—5 of FIG. 4.

With reference to FIG. 5, it is to be noted that the handle has no squared corners, thus allowing for an unobtrusive feel when held within the palm of the hand.

The front ends of the diverging arms 14, 14 are interconnected by a transversely-disposed upwardly arched head 16, the top of which will be seen to lie in an imaginary plane extended substantially along the top surface of that portion of the handle between its rearward terminus and the area of the finger engaging element and the bottom of which lies in a plane substantially below the bottom surface of the handle.

The head is disposed in a plane in a generally right angular relation to the handle.

The bristle pattern is such as to allow a spacing of approximately 4 mm between bristle termini at the bottom of the head and a spacing of approximately 7 mm between bristle termini near the horizontal center line (HCL).

Figure 6:
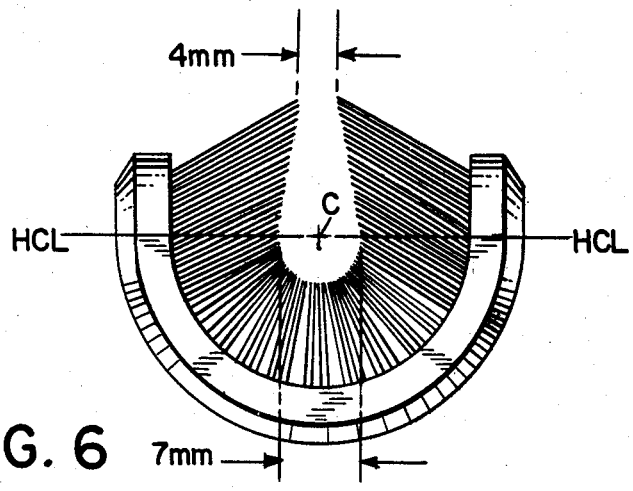
FIG. 6 is a view in end elevation showing the angularization of the bristles.
Figure 7:
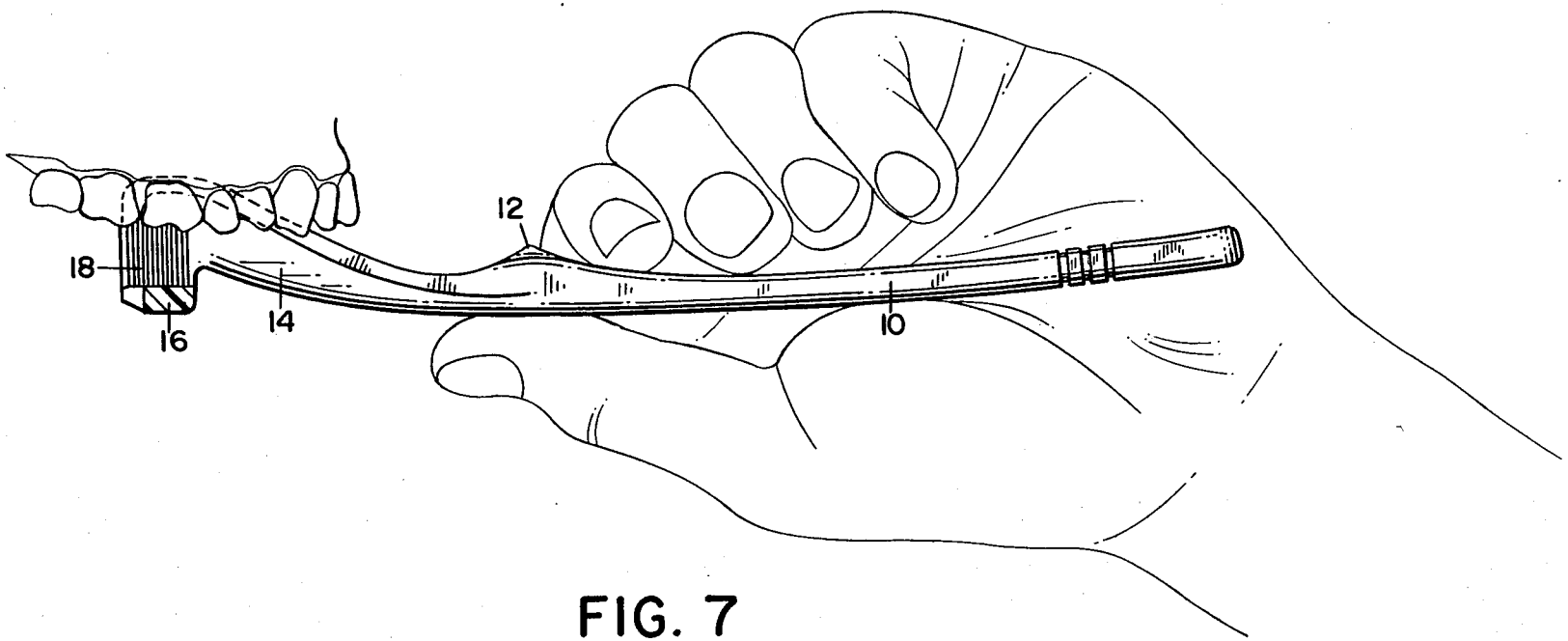
FIG. 7 is a schematic view, with part of the head being broken away, showing the brush as applied to the teeth of a user.

Spaced tufts of bristles 18 project from the inside wall of the head, extending generally inwardly toward each other from the opposite side portions of the walls but at an angle of approximately 30° to the horizontal center line HCL and extending inwardly from the middle portion of the wall toward the center point C. See FIG. 6.

The spaces between the rows of tufts preferably are greater at the middle portion of the wall of the head in order to avoid crowding thereat as the brush head is molded into its arched U-shape configuration.

The tufts are arranged in evenly spaced rows extending in the direction of the handle from one side of the head to the opposite side, each row being comprised of 3 or 4 spaced tufts save for the second row on each side where 5 such spaced tufts are provided. The tufts of each row are evenly spaced as to each other.

Not only are the tufts of each row spaced evenly as to each other around the inner wall of the head from side-to-side but the tufts of the fourth row from the spaced free outer ends of the arms are staggered as to the tufts of adjacent rows.

By virtue of this gridlike arrangement, the aforesaid fifth tuft in the second row on each side of the head will be observed to be disposed rearwardly of the plane of the innermost row of tufts so as to define, on each side of the head, a tuft particularly useful for reaching the interproximal area between adjacent teeth, especially in the area of the gingival sulcus. That is this row is meant to extend into the interproximal papilla area where often exists a concavity on the mesial buccal and distal buccal line angles adjacent to the interproximal papilla. The concavity exists on most posterior teeth, as shown in FIG. 9, and is one of the most troublesome areas of plaque accumulation, and worse, usually unknowingly to the owner of those teeth.

This bristle arrangement will be seen to define, at the bristle surfaces, an open area of tear drop configuration. Note especially FIG. 6. Such allows for a maximum cleansing of all exposed tooth crown surfaces without any great distortion of the bristles per se, thereby permitting the bristles to function at their maximum efficiency. As known, the maximum height of contour of posterior dentition ranges from the occlusal third OT to the gingival third GT of the crown. This particular bristle configuration envelops the tooth crown for a maximum cleansing effect from the gingival sulcus to the occlusal surface.

The justification for the 30° angular disposition is to allow the angled bristles to extend into the gingival sulcus from the mesial of each papilla of each tooth to the distal of each papilla of each tooth.

This brush design allows for most effective cleaning of bacterial plaque along these line angles and concavities.

With the brush in use, the bristles on the opposite sides will serve to clean the lingual (inside) and buccal (outside) surfaces of the teeth and the bristles in the mid-portion will clean the occlusal or chewing surfaces.

Additionally the side bristles will seve simultaneously to brush and massage the gums. This insures the cleaning of the gingival margins and the removing of bacterial plaque.

The combining of the capabilities of brushing and massaging assures more successful teeth care than has heretofore been possible.

I claim:

1. In a toothbrush of a configuration for allowing a user easily to reach his buccal and lingual surfaces and the confined areas where the gingival crest meets the adjacent teeth, the combination of:

an elongated handle having a bifurcated forward end, the bifurcation defining a pair of arms diverging from each other and with each arm bending downwardly in a slow curve at an obtuse angle to the general handle plane, the spaced free outer ends of the arms being interconnected by a transversely extending arched head defining opposite lower side walls and an upper middle wall therebetween, the top of the head lying in a plane extended substantially along the top surface of the handle and the bottom of the head lying in a plane substantially below the bottom surface of the handle, a gridlike arrangement of tufts of bristles projecting inwardly from the inner wall of the head with the tufts projecting from the opposite side walls at an angle approximately 30° to the horizontal center line of the head and with the tufts projecting from the middle wall toward the center point of the head, the tufts being arranged in spaced rows extending in the direction of the handle from one side of the head to the opposite side, the tufts of each row being evenly spaced as to each other, the spaces between the rows of tufts being greater at the middle portion of the head than at the spaced free outer ends of the arms, each row being comprised of 3 or 4 spaced tufts save for the second row from the spaced free outer ends of the arms on each side where 5 such spaced tufts are provided, the tufts of the fourth row from the spaced free outer ends of the arms being spaced and staggered as to tufts of adjacent rows, the fifth tuft in the second row on each side of the head being disposed rearwardly of the plane of the innermost row of tufts, with the outer ends of the tufts defining an open space of teardrop configuration.

* * * * *